United States Patent [19]

Groetschel

[11] 4,379,660

[45] Apr. 12, 1983

[54] METHOD OF AND APPARATUS FOR APPLYING MAT TO THE ROOF OF A MINE WORKING

[76] Inventor: Karl M. Groetschel, Montsalvatstrasse 1a, D-8000 München, Fed. Rep. of Germany

[21] Appl. No.: 183,825

[22] Filed: Sep. 3, 1980

[30] Foreign Application Priority Data

Sep. 7, 1979 [DE] Fed. Rep. of Germany ..... 2936206

[51] Int. Cl.[3] ..... E21D 19/00

[52] U.S. Cl. ..... 405/288; 156/577; 405/150; 405/303

[58] Field of Search ..... 405/288, 290, 291, 150, 405/146, 151, 303; 299/11, 31, 33; 156/350, 360, 577, 574; 404/84

[56] References Cited

U.S. PATENT DOCUMENTS

| | | | |
|---|---|---|---|
| 3,399,927 | 9/1968 | Groetschel | 299/11 |
| 3,613,530 | 10/1971 | Hess | 404/84 |
| 3,914,064 | 10/1975 | Gurries | 404/84 |
| 3,999,314 | 12/1976 | Miller et al. | 404/84 X |
| 4,003,208 | 1/1977 | Hornung et al. | 405/290 |
| 4,030,958 | 6/1977 | Stenemann | 156/350 |
| 4,099,785 | 7/1978 | Groetschel | 299/11 |
| 4,122,682 | 10/1978 | Groetschel | 405/294 X |
| 4,236,950 | 12/1980 | Eigenmann | 156/577 X |

FOREIGN PATENT DOCUMENTS

| | | | |
|---|---|---|---|
| 2831486 | 2/1979 | Fed. Rep. of Germany | 405/296 |
| 1376721 | 12/1974 | United Kingdom . | |

*Primary Examiner*—Dennis L. Taylor
*Attorney, Agent, or Firm*—Spencer & Kaye

[57] ABSTRACT

A method of and apparatus for applying a succession of strips of mat to the roof of an underground mine working wherein the strips are applied by an applicator means mounted on a mining machine or other transporter means, and the lateral position of the applicator means is adjustable relatively to the mining machine or transporter means so that, despite lateral deviations of the latter when the mat is undergoing laying, each newly laid strip of mat can be brought into the desired lateral position with the nearer edges of the newly applied strip of mat and the last applied strip of mat is proximate relation. A sensing means providing an electrical output representative of the position of the last applied strip of mat serves through control means to control the operation of a pressure fluid double-acting piston and cylinder forming an actuating means for adjusting the lateral position of the mat applicator.

Excessive lateral deviations of the mining machine or transporter means are detected by limit sensing elements and movement of the mining machine or transporter means is then stopped.

14 Claims, 8 Drawing Figures

METHOD OF AND APPARATUS FOR APPLYING MAT TO THE ROOF OF A MINE WORKING

BACKGROUND OF THE INVENTION

Field of the Invention

This invention relates to a method (hereinafter referred to as being of the kind specified) of applying a succession of strips of mat to the roof of an underground mine working in a manner such that each successive strip is applied along a previously uncovered zone of the roof bordering the last applied one of the previously applied strips, and with the nearer edges of these two strips in proximate relation to each other. The invention also relates to an apparatus (hereinafter referred to as being of the kind specified) comprising applicator means for applying a strip of flexible roof mat to the roof of a mine working, said strip being drawn off from a store, and transporter means for moving said applicator means in a direction longitudinally along a succession of generally parallel paths to enable successive strips of mat to be applied to the roof along respective parallel adjacent zones.

In my prior U.S. Pat. No. 3,399,927 I have disclosed the laying or applying of mat strips, for example wire mesh, in closely adjacent parallel formation. This mat applying operation follows step by step the coal cutting operation and the newly laid strips of mat are supported at intervals by roof bars of support units. However, it is not always possible to prevent the opening of gaps occurring between adjacent strips of mat and there is then an increased possibility of rocks and a corresponding amount of dust falling through these gaps.

To avoid or reduce exposure of personnel to such rock falls certain improvements were described and claimed in my U.S. Pat. No. 4,099,785 and in particular the location of the stored portion of roof mat strip in a zone already protected by roof supports.

Further, in my U.S. Pat. No. 4,122,682 I have described and claimed the further invention of effecting a mechanical connection between adjacent strips of mat as each new strip is applied to the roof, all of these inventions progressively increasing the safety of mine personnel and the cleanliness of the atmosphere by minimising dust generation arising from roof falls.

If, however, the mat applicator means is mounted on the mining machine, for example on a coal cutting machine, and in particular on a shield plate or cowl which extends part of the way around a coal cutting cylinder, while it is possible in this way to provide immediate support by way of the newly applied mat to the roof areas newly exposed behind the cutting cylinder, the mat applicator means will follow the movements of the cutting cylinder including any lateral deviations which the latter may make transversely of a coal face. In this respect unevenness in the floor of the mine working may cause rails on which the mining machine is mounted to run parallel to the coal face to exhibit differential undulations or changes in level and this causes lateral tilting of the whole mining machine so that the cutter is thereby caused to deviate laterally by way of movement towards and away from the coal face.

One consequence of this is that the lateral deviations are inevitably transmitted to the mat applicator means with the result that what should be proximate edges, one on each of respectively adjacent strips of mat, tend to be overlapped excessively or gaps allowed to exist between them.

Not only are such gaps disadvantageous for the reasons previously stated, but also their existence interferes with the proper operation of the method and apparatus the subject of my U.S. Pat. No. 4,122,682 previously mentioned and wherein the strips are mechanically fastened together.

It is, therefore, the principal aim of the present invention to reduce such gaps and excessive overlap.

SUMMARY OF THE INVENTION

According to the present invention in a method of the kind specified for applying a succession of strips of mat, I provide the improvement comprising a. sensing the lateral position of a previously applied one of said strips, b. controlling the lateral position of each newly applied strip, as it is undergoing application, in accordance with said sensed lateral position to establish the required proximate relation between the nearer edges of newly applied strip and the last applied strip respectively.

The application of each of said newly applied strips of mat may be effected at a lateral position which is still basically determined by the lateral position of a mining machine or a separate transporter means on which the mat applicator is mounted, but the position of the mat applicator means laterally with respect to the mining machine or transporter means is adjusted in response to the sensed lateral position of said previously applied strip to compensate for the lateral deviations of said mining machine or transporter means in travelling along the zone in which the newly applied mat is to be applied.

Further, while it is within the scope of the invention to control the lateral position of the newly applied mat manually, such control is preferably effected through the operation of sensing means providing an output which, through control means, controls operation of an actuating means for effecting lateral adjustment of the mat applicator means.

The invention also provides in apparatus of the kind specified, the improvement comprising the provision of a. mounting means operatively connecting said applicator means with said transporter means, and including adjustment means providing for lateral positional adjustment of said applicator means relative to said transporter means, b. power energised actuating means for effecting said adjustment, c. control means for bringing said actuating means into and out of operation as required.

BRIEF DESCRIPTION OF THE DRAWINGS

The invention is hereinafter more particularly described with reference to embodiments shown by way of example in the accompanying drawings wherein.

DESCRIPTION OF THE PREFERRED EMBODIMENT

Figure 1:
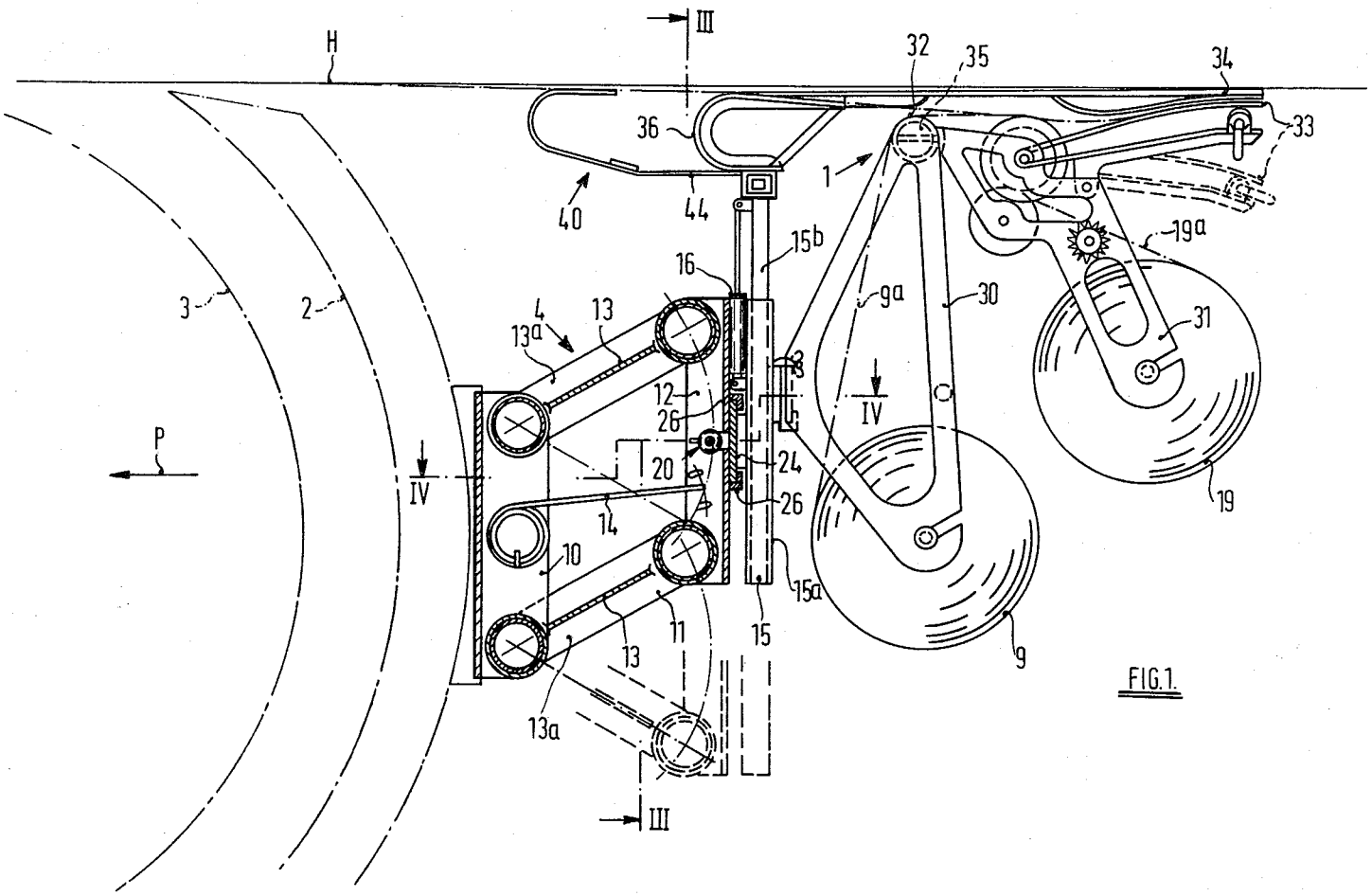
FIG. 1 is a part-sectional side elevation of a mat applicator device mounted on the cowl of the operatively effective cutting cylinder of a coal cutting machine which here serves as a transporter device for the mat applicator device, the latter in this example being associated with a stapler device for mechanised stapling together of the mutually adjacent edges of a previously and freshly laid mat strip.

FIGS. 1 to 4 of the drawings illustrate an embodiment wherein the apparatus is applied to mineral mining, e.g. coal mining, in accordance with the long-wall system. In this coal is removed from an upstanding face K by a mining machine of which the cylindrical cutter is shown at 3 and a shield plate or cowl 2. The mat applicator device, generally indicated at 1, is mounted on the cowl 2 shown in dash and dot lines, which trails behind the effective cutting cylinder 3 as the coal mining machine executes its cutting pass, thereby creating a newly exposed roof zone against which a strip of flexible mat is required to be applied. Instead of being mounted on the cowl 2 the mat applicator device 1 may be mounted for vertical adjustment on the body of the coal cutting machine with suitable coupling means between the device 1 and the cutting cylinder 3 or the cowl 2 to provide for movement in the vertical direction of the device 1 in conformity with the vertical position of the cutting cylinder.

The mat applicator device 1 is secured to the cowl 2 through the intermediary of a mounting means in the form of a holder or support mechanism 4. This comprises a securing frame 10 mounted on the cowl 2, a guide linkage 11 pivotally connected to said frame 10 and a second securing frame 12 pivotally connected to the guide linkage 11 parallel to securing frame 10 and vertically guided. The guide linkage 11 comprises upper and lower parallel forming links and a parallel link mechanism, each link comprising laterally spaced arms 13*a* joined by connecting plate 13 for improved rigidity. Two laterally spaced springs 14 (FIG. 4) act between the two securing frames 10 and 12 to urge the mat applicator device 1 in the upward direction towards the roof H (FIG. 1) through the intermediary of a vertical telescopic prop 15 which is mounted on the second frame 12. The mat applicator device 1 is carried on the inner element 15*a* of the telescopic prop 15 which, in the illustrated embodiment, is itself vertically adjustable for length by means of an hydraulic cylinder 16 providing extension of the inner member relative to the outer element 15*b* of the telescopic prop in order to be able to raise the mat applicator device 1 from a lower position prior to starting mat laying to a suitably higher position relative to the cowl 2 and press the device against the roof.

The telescopic prop 15 is mounted on the second frame 12 through the intermediary of a transverse displacement device. This transverse displacement device comprises a double-acting piston-cylinder unit 20 whereof the piston rods 21*a*, 21*b* (FIGS. 1, 3) are connected with the second frame 12 whilst the cylinder 22 is rigidly connected with a slide plate 24 which itself is rigidly connected to the outer element 15*a* of the telescopic prop 15. A channel-section guide 26 connected with frame 12 serves to support and guide the plate 24 slidably in a horizontal direction transversely of the direction of transport of the coal cutting machine. On application of pressure to one or the other chamber of the double-acting piston/cylinder unit 20, the cylinder 22, and with it the telescopic prop 15, and the entire mat applicator device 1 are displaced laterally in one or the other direction relative to the holder and support mechanism 4.

In the illustrated example, the mat applicator device 1 comprises a frame 30 adapted to receive a store or supply of matting 9 in the form of a roll, and a transverse tube 32 arranged in the upper region of the frame 30 near the roof acting as a deflector to steer the mat strip 9*a* which is drawn off the store into the correct position for application to the roof. The leading end of the mat strip 9*a* is clamped fast against the roof (FIG. 2) and the mat is automatically drawn off the roll 9 under the power applied to effect forward transport movement of the device mounted on the cowl of the effective cutting cylinder as the associated coal getting machine advances. The arrangement is such that the new mat strip 9*a* which is fed to the roof is directed into a parallel position with overlap of suitable width relative to the marginal region 8*a* of the previously laid mat strip 8 which lies above the mine roof support element, e.g. roof bar 5.

In the illustrated example, there is further provided a rolled or coiled store 19 (FIGS. 1,3) of stapling strip 19*a* which is removably carried by a cradle 31 itself secured relatively at 35 (FIG. 1) to the deflector tube 32, and from which a suitable stapling strip 19*a* is drawn and fed to the overlap region of the mat strips 8, 9. In coordination with the application of the new mat strip 9*a*, the stapling strip 19*a* runs through the space between a pair of pressing dies 33, 34. The lower die 33 is adapted to be lowered when required into the position shown in dot-and-dash lines. The upper die 34 comprises an arcuate downwardly directed leading end 36 by which it is detachably secured to the top of the inner element 15*b* of the telescopic prop 15. Suitable staple pins, not shown in the drawing, which are incorporated in the stapling strip 19*a* penetrate the overlapped mat strips and are subsequently converted from open channel shape to closed clenched shape by the pressure of the dies 33, 34 as the strips pass therebetween and a continuous stapled seam is made which mutually connects the mat strips. As earlier mentioned, both the mechanised mat laying method, and the apparatus means for carrying it out, as well as the described mat stapling method and the apparatus for carrying it out are more fully disclosed in my U.S. Pat. No. 4,122,682.

Forwardly of the mat applicator device 1, there is provided a sensing means in the form of an array of sensors 40, which in the illustrated example (FIGS. 1, 2) comprises three parallel sliding sensors or wipers 41, 42, 43 which are connected by elastic holder means 44 with the mat applicator device.

Figure 2:
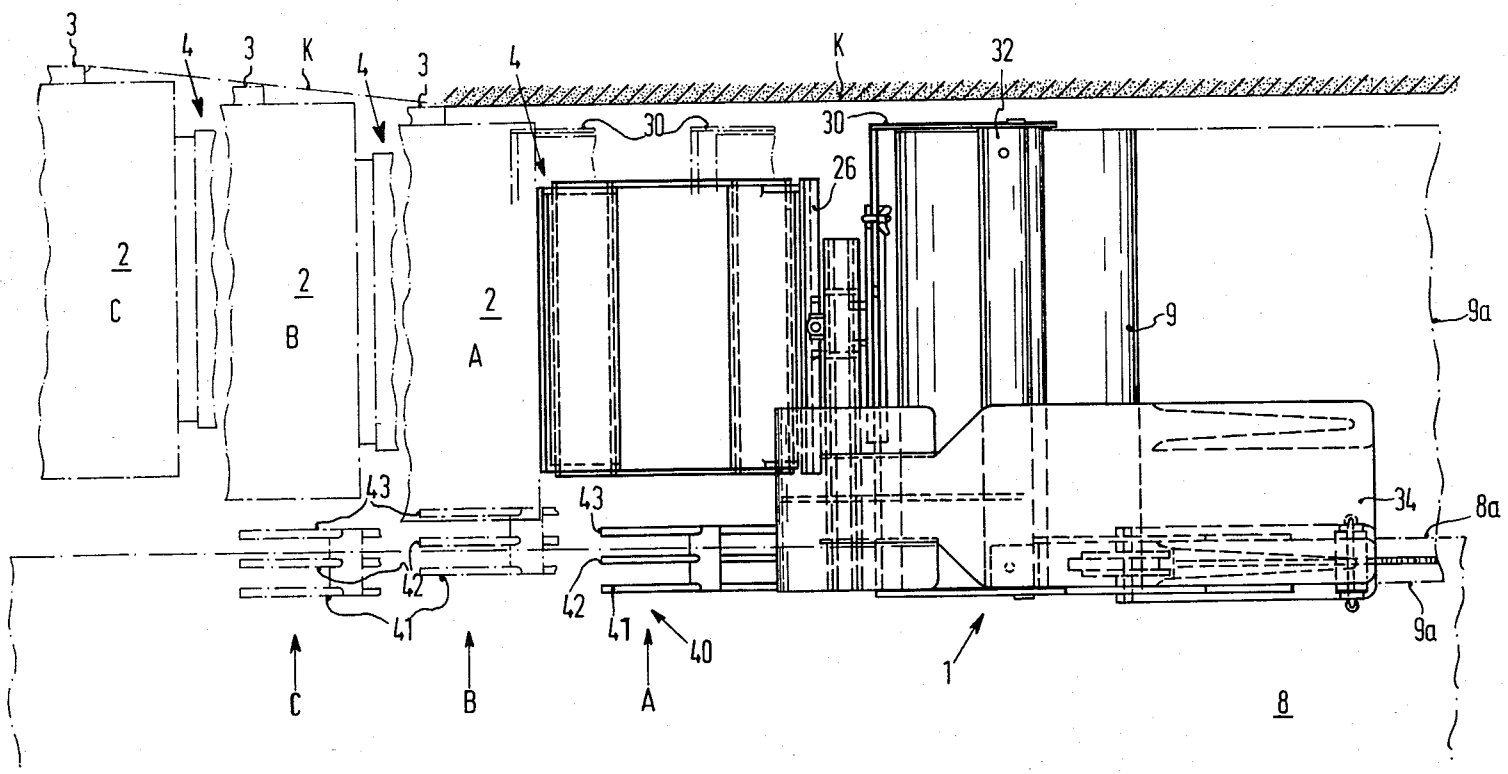
FIG. 2 is a plan view of the device according to FIG. 1 schematically illustrating a sensor array which is coupled with the mat applicator device to move therewith in different lateral positions of the transporter device.

By virtue of their coupling with the mat applicator device 1 the sensors in the array 40 move with the mat applicator device in the transport direction P and horizontally and laterally of this direction towards and away from the coal face K (FIG. 2). The vertical position or height of this array 40 is also adjustable in conformity with that of the mat applicator device. However, by reason of the elastic holder means 44, the array 40 has sufficient freedom to follow irregularities in the roof surface H, so that the sensors will remain in touch with the roof, or with the previously laid mat strip 8.

According to this invention the method of bringing a new mat strip 9*a* into the proper proximate relation with the adjacent margin of a previously laid mat strip 8, and the associated means and devices for implementing this method, will now be more particularly described with reference to FIGS. 2, 3 and 6. In the plan view of FIG. 2 the mat applicator device 1 is shown in continuously drawn lines in its normal position, i.e. in a position wherein as the coal getting machine advances in transport direction P, the mat applicator device 1 maintains that margin of the new mat strip 9*a* which is remote from the coal face in a position of overlap with, and parallel to, the adjacent lateral margin 8*a* of the previously laid mat strip 8. This ensures that the margin 8*a* of the previously laid mat strip 8 is introduced jointly with the margin 9*a* of the new mat strip 9 into the slot between the pressing dies 33, 34, and these two margins are suitably mutually connected by means of the stapling strip 19*a* (FIG. 1), so that the individually laid strips of mat are joined up to provide a continuous protective cover mat over the whole of the support system applied to the undersurface of the roof in the region of the long wall coal face K. Since the mat applicator device 1 is connected via the support mechanism 4 and telescopic prop 15 with the cowl 2 and through this latter with the cutting cylinder of the coal cutting machine, it must inevitably also share the lateral deviation movements of such cowl and cylinder. As a result of such lateral movements as inevitably occur due to a variety of causes, the coal face K will be no longer precisely parallel with the desired, and as far as possible, straight, transport path of the mat applicator device, but will change. This is shown by way of example as indicated in dot-and-dash lines in the left-hand part of FIG. 2, when the cowl 2 with the holder mechanism 4 advances from position A through B to C.

In the normal position of the mat applicator device as shown in full outline in FIG. 2, the two sensors 41, 42 slide over the margin 8*a* of mat strip 8 whilst the third sensor 43 slides directly over the roof surface, e.g. adjacent to the outer edge of the matting strip 8. If the lateral position of the cutting cylinder 3 or of the cowl 2 changes in accordance with the modified coal face K shown in FIG. 2, there will naturally be a similar positional change of the sensor array 40. However, the latter will follow the lateral shift of the cutting cylinder 3 only up to the moment where the sensor array 40 on its way from position A has moved into position B. As shown in dot-and-dash lines, the sensor 42 is then adjacent to, but spaced from, the edge of the mat strip 8 so that its contact with this mat strip 8 is broken.

By the same amount, which typically is approximately 2 to 3 cm, the width of overlap of the two mat strips 8 and 9 also decreases. The sensor output which is in this embodiment an electrical signal derived from the interruption of contact between sensor 42 and mat strip 8 is processed in a control system hereinafter more particularly described to provide a suitable servo-signal which causes the piston/cylinder device 20 to be actuated in the direction in which it restores the mat applicator device 1, and with it the sensor array 40, into positions, diagrammatically shown at C. The sensor array then again has the designed degree of overlap with mat strip 8 and the required overlap between the mat strips 8 and 9 is restored. This will occur even if the cutting cylinder 3 and the cowl 2 are laterally deflected by a further amount towards the coal face K within the extent of lateral adjustment provided by the mounting means for the mat applicator.

Figure 3:
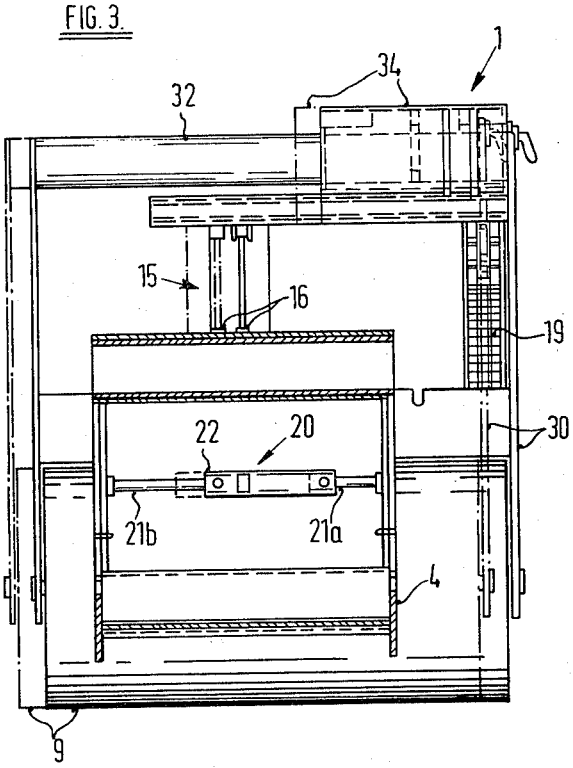
FIG. 3 is a view in cross-section on the line III—III in FIG. 1 indicating a lateral displacement of the mat applicator device and all parts coupled therewith for adjusting the lateral position of a newly laid mat strip relative to the edge of the previously laid mat strip.
Figure 4:
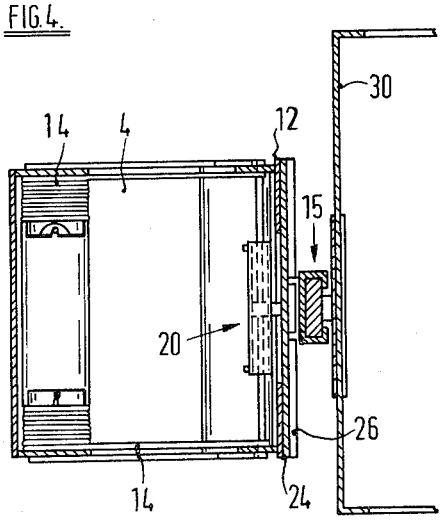
FIG. 4 is a part-sectional view taken on the line IV—IV in FIG. 1.

In FIG. 3, intended to illustrate the method also as viewed endwise of the direction of travel, the full lines show the position of mat applicator device 1 relative to the support mechanism 4 and cowl 2 which would subsist but for the intervention of the actuating means, namely piston/cylinder unit 20, triggered by the appropriate sensor signal to apply a correcting displacement to the mat applicator device bringing it into the position shown in dot-and-dash lines. Thus, the permitted amount of lateral deviation which still enables the two mat strips to be securely stapled together will not be exceeded.

In the event of a lateral positional change of the coal cutting machine or its cowl 2 in the opposite direction, i.e. in the direction away from the coal face K, the sensor 43 will engage with the adjacent edge of the previously laid mat strip 8. This will produce a sensor signal which in turn gives rise to actuation of the piston/cylinder device 20 in the opposite direction, by application of fluid under pressure to the cylinder chamber which is shown on the left-hand side in FIG. 3, whereby the mat applicator device 1 with its associated parts is displaced laterally to the right until the lateral positional change of the coal cutting machine has been compensated. As soon as the sensor 43 is once more out of contact with the mat strip 8, the control signal for the piston/cylinder unit 20 is discontinued and the latter returned to a medial position.

Figure 5:
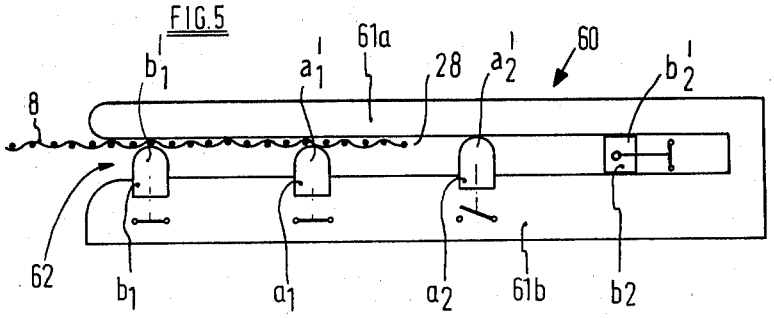
FIG. 5 is a schematic view of a mat guide engaging the edge region of the previously laid mat strip with a special sensor array for scanning the position of said previously laid mat strip.
Figure 6:
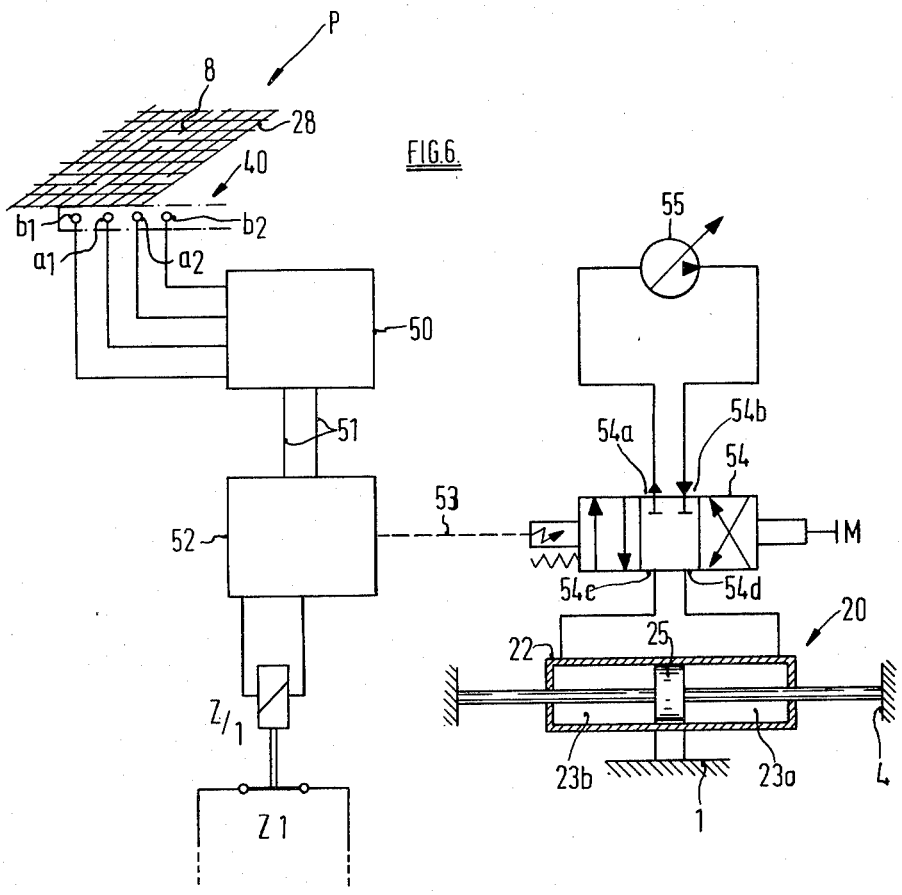
FIG. 6 is a block diagram of a control circuit designed to maintain a predetermined relative position of adjacent edges of previously and freshly laid mat strips despite transverse positional variations of the end plate or coal cutting machine.

FIG. 6 shows a block circuit diagram of one example of regulating control system which may be used for compensation of lateral deviations of position of the coal cutting machine. The sensor array 40, mechanically supported from the mat applicator device 1, scans the margin of mat strip 8 by means of a row of sensors which are spaced apart laterally of the margin of the mat strip. In FIG. 6 four discrete sensors are shown in laterally adjacent formation, the central sensors a1 and a2 being arranged, like sensors 42 and 43 in FIG. 2, one on each side of the outer edge 28 of mat strip 8 to provide data by way of respective signals as to the position of the mat applicator device relative to the edge of the previously laid mat strip 8. The outer sensors b1 and b2 are limit sensors which initiate generation of a stop signal in the event of excessive lateral deviations of the mat applicator device 1 relative to the previously laid mat strip 8, and which can no longer be adequately compensated by the above described control system. The stop signal controls means for stopping the movement of the coal cutting machine along the direction P. These sensors a1, a2, b1, b2 may be either contactless sensors, e.g. magnetic sensors or light responsive sensors, or they may be contact sensors making mechanical or electric contact with the mat strip 8. The design and construction of contact sensors will be more particularly discussed below with reference to FIG. 5.

The sensor array 40 is connected by suitable connecting lines with a converter unit 50 which converts the sensor scanning signal into a suitable form, usually electric signal constituting an error signal which is then fed via lines 52 to a control or regulating unit 52. The control or regulator unit 52 is of a form to respond to the error signal representing deviation of the sensors a1, a2 from their designed or normal position (which is diagrammatically shown in FIG. 6) relative to the mat strip edge 28 and provide a control signal applied via conductors 53 to the input element 54 of a servo means which includes piston and cylinder unit 20. In the example of FIG. 6 this element 54 comprises a 3-position 2-way valve by means of which the double-acting piston/cylinder unit 20 can be caused to remain in its existing position, or subjected to energisation in a mode to cause relative movement between the piston and cylinder in one direction or the opposite direction. The pressure fluid inlet ports 54*a*, 54*b* of the valve are connected with a source of fluid (preferably hydraulic) under pressure represented by a pump 55. In the absence of an error signal the valve 54 remains in the position shown in FIG. 6 towards which it is spring biased. The inlets are closed and the outlet ports 54*c*, 54*d* are also closed so that piston 25 is hydraulically "locked" in its existing position until an error signal is generated.

When the sensor array 40, by means of one of the sensors a1 or a2, detects a lateral deviation of the mat applicator device 1 relative to its normal position with regard to the edge 28 of mat strip 8, the control unit 52 receives a positive or negative error signal and issues via line 53 a control signal to the three-position valve 54 which, depending on the direction of the lateral deviation and sign of the signal, displaces the valve 54 to the right or left-hand side so that either port 53*c* and chamber 23*a* or port 53*d* and chamber 23*b* on the left-hand side are connected with the pressure source 55 and the other outlet port in each case is connected to an exhaust reservoir. The cylinder 22 is then displaced respectively to the left or right relative to piston 25. As soon as the sensor array 40 has returned to its designed or normal position relative to the previously laid mat strip 8, the error signal in lines 51 disappears and the valve assembly 54 of the servo device is restored by means of a spring to the initial position as shown in FIG. 6. The piston 25 is then "locked" hydraulically in the position which it then occupies.

The "limit" sensors b1 and b2 are also connected with the converter 50 and the control unit 52 on actuation of one of these limit switches b1 or b2. The converter unit is arranged to generate a stop signal which actuates a stop means, here represented as a relay A/1, having contacts A1 which may be in the power circuit to the drive motor for advancing the coal cutting machine or may be in the electrical circuit of solenoid hydraulic valve means for controlling hydraulically energised means stopping the machine. The sensors b1, b2 are so arranged that they can be actuated only when due to an unusually wide lateral deflection in one or the other direction, restoration of the mat applicator device to bring the mat strips 8 and 9 into the proper relative positions cannot be achieved so that they cannot be secured together by the stapling strip. This arrangement also prevents the mat applicator device 1 from colliding with roof support units in the event of excessive transverse deflections in one direction. In such cases it is necessary to switch off the machine whereupon such excessive lateral deviation can be remedied manually provided that the pressing die 33 is first folded down into the position shown in dotted lines in FIG. 1.

In the arrangement according to FIG. 2 the sensors 41, 42, 43 may be wipers, or sliding sensors, which contact the mat strip 8 which may be made of wire mesh. In this arrangement sensor 41 is constantly in current transmitting relation with the mat strip 8, and so long as the mat applicator device 1 is in the correct position relative to the mat strip 8 a circuit is completed solely via sensor 42. As soon as the sensor 42 is displaced by a lateral deflection of the coal cutting machine or its cowl 2 into the deflected position indicated at B in FIG. 2, sensor 42 moves out of contact with adjacent mat strip 8, there is no longer any flow of current in the circuit containing sensors 41 and 42, a deviation is detected. A corresponding error signal developed in converter 50 causes operation of control unit 52 and causes an appropriate command signal to be fed through line 53 to operate the device 20 in that direction which will restore the mat applicator device to the proper position relative to the mat strip 8 (as represented at C, FIG. 2). In the event of an oppositely directed lateral deflection of the mat applicator device 1 taking place, the sensor 43 normally out of contact then makes contact with the mat strip 8, and an opposite command signal is fed through line 53 and the device 20 energised in a sense to move mat applicator device 1 in the opposite direction again to the proper position (C, FIG. 2). Functions corresponding to those performed by the sliding sensors 41, 42, 43 may also be executed by means of contact trolleys, or rollers, which are resiliently pressed against the mat and roof surfaces.

The input element 54 of the servo means may also be operated by means of a manual control member for application of pressure fluid to the right or left-hand chamber 23*a*, 23*b* of the piston/cylinder unit 20. This control member is shown at M in the block diagram of FIG. 6. With the aid of this control member M a single operator sensing visually the position of the applicator relatively to the last applied strip 8 can adjust the position of mat applicator device 1 laterally of the direction of travel P of the coal cutting machine in such a way that it will follow the edge 28 of mat 8 with adequate accuracy.

Instead of the sensor array 40, converter unit 50, and the control unit 52 in the closed control circuit according to FIG. 6, remote control means may be provided wherein a transmitter, which may be hand held, controls a receiver performing the function of unit 52, applies a suitable command signal to lines 53 to control and actuate the input element of servo device 54.

FIG. 5 schematically shows a guide device 60 by means of which the marginal region of a mat 8, made for example of wire mesh, may be constrained or formed into a suitable flat condition at a predetermined position relative to the mat applicator device 1 and scanned by a contact studded or contactless sensor assembly 40. This device 60 comprises a U-section body having two substantially flat plate-like parallel limbs 61*a* and 61*b* having their lengths extending transversely of the length of the roof mat and defining between them a comparatively narrow gap or slot 62 to accept the margin of the matting strip 8. At the closed end of the device 60 the two limbs 61*a* and 61*b* are rigidly connected with one another. This guide device 60 is mounted forwardly of the mat applicator device 1 (as seen in FIG. 1) viewed in the direction of travel of the coal cutting machine, and supports the sensor array 40. Preferably it is elastically mounted on the mat applicator device in order to be able to accommodate some vertical uneveness over the surface of the roof which inevitably occur in practice. The limbs 61*a* and 61*b* are rounded to saddle configuration at their leading and trailing edges at least in the area of the gap or slot 62 so that they can slide freely over the margin of the mat strip 8, and the latter can freely enter the slot at the left-hand end (FIG. 5). The lower limb 61*b* serves as the mounting means for the plurality of spaced sensors. As shown these may be in the form of mechanical pressure operated switches which have operating plungers a1', a2', b1', b2'. The plungers for all of these switches except b2 are of dome shape at their upper ends to facilitate sliding over the mat strip. The plungers are depressed by the roof mat strip as this slides relatively through the slot 62.

FIG. 5 shows the four sensors b1,a1, a2 and b2 according to the block diagram of FIG. 6. The plunger b2' of the limit sensor b2 de-limits the slot 62 on that side which is directed away from the mat and is actuated to open normally closed switch b2 whenever the mat applicator device, and with it the guide device 60, are excessively deflected towards the previously laid mat strip 8 so that the edge 28 of mat strip 8 engages and depresses plunger b2'. The sensors a1, a2, b1 may be mounted in recesses in the lower limb 61*b* into which the domed plungers can be depressed and which serve as guides for these plungers.

Instead of the mechanically actuated contact sensors shown in FIG. 5, it is possible to provide a corresponding array of electro-magnetic sensors or light responsive sensors to scan the position of the matting strip edge in the guide slot. The light sources would be mounted in or on the upper limb 61*a*.

Figure 7:
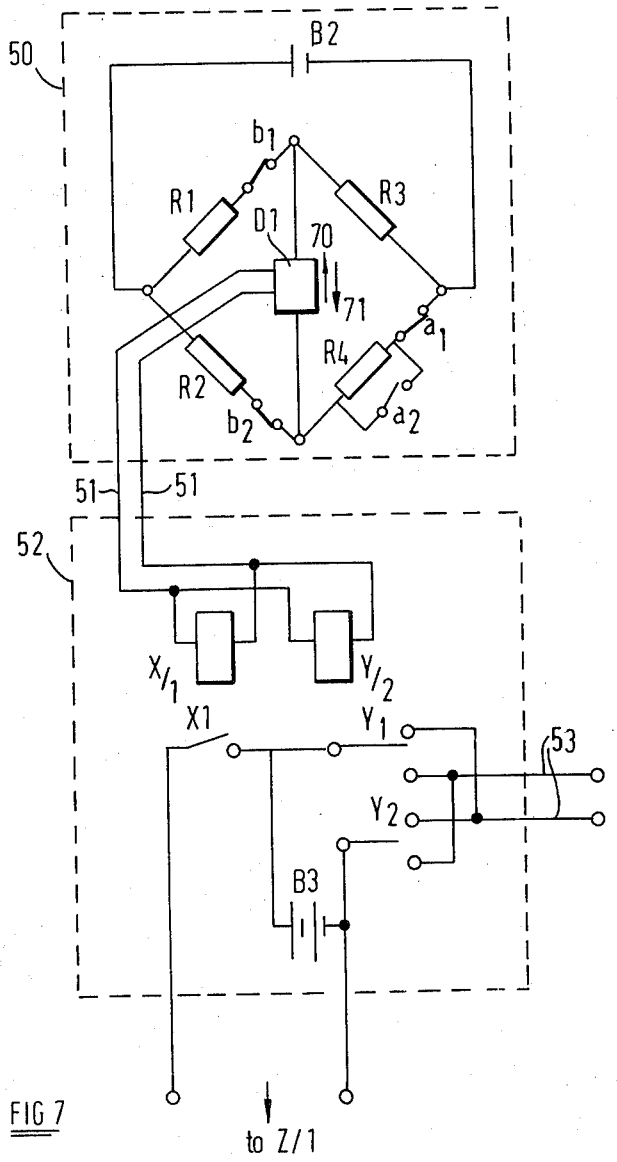
FIG. 7 is a circuit diagram showing a suitable circuit configuration for devices 50 and 52 of FIG. 6 where the sensors are in the form of switches.

Referring to FIG. 7, this illustrates in more detail one form of converter unit 50 and control unit 52 which may be employed when the sensors are in the form of switches. Sensor a1 normally overlaps the margin of the strip 8 and provides a "switch closed" output while sensor a2 is normally in non-overlapping relation with this margin and provides a "switch open" output.

Thus the switches a1, a2, b1, b2 may be connected in a bridge circuit connected to a suitable power source such as a battery B2, the arms of the bridge containing impedances which may be in the form of resistors R1 to R4. In the normal position of the sensor array, all of the sensor switches except a2 will be closed and in that condition the bridge is balanced and no current flows through the balance detector D1. The balance detector may comprise a single impedance such as a resistor, or it may comprise an amplifier having a zero output when the bridge is balanced and a positive and negative output respectively when the bridge is unbalanced in opposite senses.

The output from the detector D1 is connected in a circuit containing two relays of which one, X/1, which responds to operation of the limit switch sensors b1, b2 and the other, Y/2, which responds to operation of the sensors a1, a2 to provide a positive or negative output on the lines 52 to the input element 54 of the servo means.

The values of the resistors R1 to R4 are selected to provide bridge balance when all sensor switches except a2 are closed. If a2 closes short circuiting R4, unbalance current will flow in the direction of the arrow 70 through the detector means D1, whereas if sensor switch a1 opens, current will flow in the direction of arrow 71. The values of the resistors R1 to R4 are also selected to provide that the unbalance output currents have a predetermined value, for example +A1 milliamps and −A1 milliamps, according to the direction of the unbalance current.

Relay Y/2 has changeover contacts Y1, Y2 which are moved in the upward direction or downward direction as seen in FIG. 7 for respective different directions of unbalance current and provide the required output on lines 53. Relay X/1 is designed to have a pull-in value of current which is greater than the magnitude of A1 and hence the contacts X1 remain open.

If however the lateral deviation is of such extent that either of the limit switch sensors b1 or b2 opens, the unbalance current will be increased to a value +B1 or −B1, and at these values of curent (of either sign) relay X/1 will pull in, contacts X1 will close and relay Z/1 will be energised by current from the battery B3 and contact Z1 closed and stop the machine.

It will of course be understood that instead of connecting the limit switch sensors b1 and b2 in the bridge circuit (so as to provide an operating output for relay X/1 through the same lines 51 as are used to convey the error signal to relay Y/2), they could be connected in a separate circuit as shown in, and described with reference to, FIG. 8. Further, it is to be understood that the showing of only two lines 51 in FIG. 6 is diagrammatic only and that any number of conductors required by the particular configuration of the circuit may be utilised.

Figure 8:
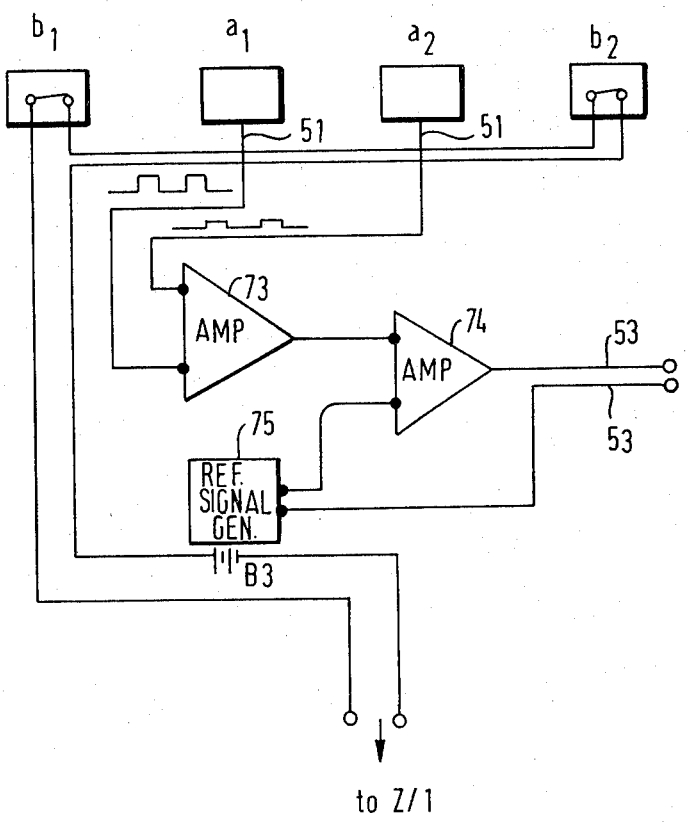
FIG. 8 shows a suitable circuit configuration for the devices 50 and 52 where the sensors other than the outer limit switches, where provided, are proximity devices either electro-magnetic or light responsive.

Referring now to FIG. 8, this shows a circuit configuration of devices 50 and 52 combined which would be suitable for use where the sensors a1, a2 each provide a cyclic electrical output, for example comprising a train of pulses as the mesh wires of the mat strip 8 pass the sensor concerned. This form of output would normally be generated where the sensors are electro-magnetic or light responsive. The pulses as shown for the output of sensor a1 would have a fixed magnitude so long as the margin of the mat overlaps with the sensor a1. The sensor a2 may provide no signal at all or it may provide a train of smaller amplitude pulses as typically shown in FIG. 8.

The pulse trains are fed along lines 51 from sensors a1, a2 to an amplifier which may be a summing amplifier providing an output which is either the sum of the peak values of the pulses in the two trains or the integrated values whichever may be convenient.

This output forms one of the inputs to a differential amplifier 74 to which is fed a reference signal from a reference signal generator 75.

According to whether the sum of the output from a1 and a2 is greater than, or less than, the amplitude of the reference signal, a positive or negative output is fed along lines 53 to the input element of the servo means. It will be noted that two lines have been shown both in FIG. 7 and FIG. 8 and that the single line shown in FIG. 6 is diagrammatic only.

In FIG. 8 the simplified system is adopted to provide a controlling output from limit switch sensors b1, b2. These are simply connected in series with each other and with a suitable source of current such as the battery B3 to provide energisation or not of relay Z/1.

The circuit shown in FIG. 7 would also be suitable for use with the sensors 41, 42, 43. In this case element 41 would be connected to the junction of R4 with the two switches a1, a2, sensor 42 would be connected to the right-hand terminal of the bridge circuit to which a1 is shown connected, and sensor 43 would be connected to the lower end of R4.

Alternatively, where a sensor array of the type illustrated in FIG. 5 is provided, this may be associated with a binary logic circuit for which the input signals are provided by the operative or switch positions of the various sensors.

The applicator and sensing means need not be mounted on the mining machine but could be mounted on their own transporter which may be coupled to the mining machine and run on the same conveyor track as this machine or may be power driven itself to run on such track.

I claim:

1. In a method of applying a succession of strips to the roof of an underground mine working in a manner such that each successive strip is applied along a previously uncovered zone of the roof bordering the last applied one of the previously applied strips, and with the nearer edges of these two strips in proximate relation to each other, the improvement comprising a. sensing the lateral position of a previously applied one of said strips, b. controlling the lateral position of each newly applied strip, as it is undergoing application, in accordance with said sensed lateral position to establish the required proximate relation between the nearer edges of newly applied strip and the last applied strip respectively, and wherein c. application of each of said newly applied strips of mat is effected at a lateral position determined by the lateral position of a transporter means on which a mat applying means for applying the strips is carried, and which travels longitudinally of the zone in which the newly applied strip is required to be applied, d. the position of the mat applying means is laterally adjusted relatively to that of said transporter means in accordance with the sensed lateral position of said previously applied strip, and in a direction and by an amount such as to compensate for lateral deviation of said transporter in travelling along said zone and which would otherwise cause said proximate edges to be spaced apart or to overlap by more than a predetermined amount.

2. The method claimed in claim 1 wherein the transporter means comprises a mining machine having a means for removing mineral from an upstanding face of the working extending longitudinally of the zone in which the newly applied strip is required to be applied, and at the lateral boundary of said zone remote from the zones along which the already applied ones of said strips have been applied.

3. The method claimed in claim 1 wherein a. the lateral position of said previously applied one of said strips is sensed by scanning an edge of this strip along its length with sensing means at a position forwardly of the mat applicator means for applying said newly applied strip of mat providing an output representing the difference between the lateral position of this edge and the lateral position of said sensing means, b. mat applicator means for applying said newly applied strip and said sensing means are both subjected to lateral positional adjustment in a direction to reduce or eliminate said difference.

4. The method claimed in claim 1 wherein a. said sensing of the lateral position of said previously applied one of said strips includes the step of sensing whether a predetermined limit of deviation has occurred between the lateral position in which the newly applied strip of mat is being applied and that in which it is required to be applied to maintain the required proximate relation between said nearer edges, b. the application of said newly applied strip is stopped when said limit is reached.

5. The method claimed in claim 2 wherein said previously applied one of said strips is the last applied one, and its lateral position is sensed by sensing the lateral position of said nearer edge of this strip bordering the zone in which the newly applied strip is required to be applied.

6. The method claimed in claim 1 comprising the further step of mechanically fastening together the last applied one of said previously applied strips and the newly applied strip as the latter is undergoing application.

7. The method claimed in claim 1 wherein the proximate relation between the nearer edges of the last applied one of the previously applied strips and the newly applied strip respectively is that adjacent margins of these two strips are in overlapping relation.

8. In apparatus comprising applicator means for applying a strip of flexible roof mat to the roof of a mine working, said strip being drawn off from a store, and transporter means for moving said applicator means in a direction longitudinally along a succession of generally parallel paths to enable successive strips of mat to be applied to the roof along respective parallel adjacent zones, the improvement comprising the provision of a. mounting means operatively connecting said applicator means with said transporter means, and including adjustment means providing for lateral positional adjustment of said applicator means relative to said transporter means, b. power energised actuating means for effecting said adjustment, c. sensing means for sensing the lateral position of a previously applied one of said strips of mat, said sensing means providing output varying in dependence upon the difference between said position and the position of the sensing means, and d. control means operatively connected with said sensing means and responsive to said output thereof to control operation of said actuating means to bring said actuating means into and out of operation as required in a manner such that each newly applied strip of mat is applied in such lateral position as to establish the required proximate relation between nearer edges of the last applied strip and the newly applied strip notwithstanding lateral deviation of said transporter means in moving along each of said paths.

9. Apparatus according to claim 8 wherein said transporter means comprises a mining machine having means for removing mineral from an upstanding face of the working extending longitudinally of the zone in which the newly applied strip is required to be applied, and at the lateral boundary thereof remote from the zones along which the already applied ones of said strips have been applied, the lateral position of said applicator means being determined by the output from said sensing means notwithstanding deviations of lateral position of said mining machine.

10. In apparatus comprising applicator means for applying a strip of flexible roof mat to the roof of a mine working, said strip being drawn off from a store, and transporter means for moving said applicator means in a direction longitudinally along a succession of generally parallel paths to enable successive strips of mat to be applied to the roof along respective parallel adjacent zones, the improvement comprising the provision of a. mounting means operatively connecting said applicator means with said transporter means, and including adjustment means providing for lateral positional adjustment of said applicator means relative to said transporter means, b. power energised actuating means for effecting said adjustment, c. sensing means for sensing the lateral position of a previously applied one of said strips of mat, said sensing means providing an output varying in dependence upon the difference between said position and the position of the sensing means, d. control means for bringing said actuating means into and out of operation as required, and operatively connected with said sensing means and responsive to said output thereof to control operation of said actuating means in a manner such that each newly applied strip of mat is applied in such lateral position as to establish the required proximate relation between nearer edges of the last applied strip and the newly applied strip notwithstanding lateral deviation of said transporter means in moving along each of said paths, and wherein e. said sensing means is mounted on said transporter means to undergo lateral positional adjustment corresponding to that of said applicator means, and the output provided by said sensing means varies in response to the degree of lateral overlap between said sensing means and the margin of the last applied one of said previously applied strips of mat, and said sensing means includes laterally spaced sensing elements which in a normal position of said sensing means respectively are in overlapping and non-overlapping relation with said margin and provide respectively different values of output in response to maintainance of this relation, f. said control means responds in a first mode when both of said elements provide outputs corresponding to an overlapping relation and in another mode when both of said elements provide outputs corresponding to a non-overlapping relation, respectively to bring about operation of the actuating means in one lateral direction or the opposite lateral direction to restore the applicator means and the sensing means to a position corresponding to the normal position of the latter.

11. Apparatus according to claim 8 wherein a. said sensing means includes limit sensing elements for sensing lateral deviation between said sensing means and said previously applied one of said mats brought about by lateral deviation of said transporter means and exceeding a predetermined value, b. said control means is responsive to output from said limit sensing element when said predetermined value is exceeded to stop further movement of said transporter means along its path.

12. Apparatus according to claim 8 wherein a. said sensing means comprises a mounting member defining an open-sided slot for reception of the nearer margin of said last applied one of said previously applied strips of mat, b. said sensing means comprises sensing elements carried by said mounting member at laterally spaced position along said slot for sensing the presence of said margin of said last applied strip therein.

13. Apparatus according to claim 12 wherein said sensing elements have respective operating plungers projecting into said slot and which are depressable in response to contact with the margin of said last applied strip of mat passing through said slot.

14. Apparatus according to claim 8 wherein said actuating means comprises a pressure fluid energised double-acting piston and cylinder means, and said control means includes valve means for controlling admission of pressure fluid to said piston and cylinder means in an appropriate direction to bring about positional lateral adjustment of said applicator means in one lateral direction or the other, or to maintain said applicator means in a stationary position laterally of said transporter means.

* * * * *